US007687695B2

(12) United States Patent
DeJule

(10) Patent No.: US 7,687,695 B2
(45) Date of Patent: Mar. 30, 2010

(54) ANTI-WOLF-NOTE RESONATOR ASSEMBLY FOR A STRING INSTRUMENT AND METHOD OF ASSEMBLING THE SAME

(76) Inventor: Michael Clement DeJule, 29A Mapleridge Ave., Clifton Park, NY (US) 12065

( * ) Notice: Subject to any disclaimer, the term of this patent is extended or adjusted under 35 U.S.C. 154(b) by 215 days.

(21) Appl. No.: 12/021,056

(22) Filed: Jan. 28, 2008

(65) Prior Publication Data

US 2009/0188370 A1 Jul. 30, 2009

(51) Int. Cl.
*G10D 1/00* (2006.01)

(52) U.S. Cl. ..... 84/270

(58) Field of Classification Search ..... 84/270–272, 84/290, 294

See application file for complete search history.

(56) References Cited

U.S. PATENT DOCUMENTS 4,364,990 A 12/1982 Haines
4,969,381 A 11/1990 Decker, Jr. et al.
5,929,353 A 7/1999 Taninbaum
6,610,915 B2 8/2003 Schleske
6,770,804 B2 8/2004 Schleske
2007/0084335 A1 4/2007 Silzel

OTHER PUBLICATIONS

Arthur H. Benade, "Fundamentals of Musical Acoustics," pp. 566-575, Dover Publications, Inc. 2nd Revised Edition.
Richards, et al. "Vibrating Bodies-Sound" pp. 266-269, Modern University Physics, Addison-Wesley Publishing Company, Inc. (1960).
Prof. Gerhard A. v. Reumont, "How to Improve the Resonance Conditions of Musical Instruments by Vibration Dedamping" pp. 39-49, Henry Srobel, Violin Maker & Publisher.
J.M. Bowsher, "Alexander Wood's The Physics of Music" pp. 100-101, 7th Ed. Chapman and Hall.
Lothar Cremer, "The wolf tone" pp. 274-282, The Body as a System of Few Degrees of Freedom, The MIT Press, Cambridge, Massachusetts (1984).

*Primary Examiner*—Kimberly R Lockett
(74) *Attorney, Agent, or Firm*—Armstrong Teasdale LLP

(57) ABSTRACT

A method of assembling an anti-wolf resonator assembly for use with a string instrument is provided. The method includes positioning a first portion of the resonator assembly against a first side of a surface of the instrument, and magnetically coupling a second portion of the resonator assembly to a second side of the instrument surface that is opposite the first side of the surface. The surface is positioned between the first and second portions of the resonator assembly. The resonator assembly is configured to dampen at least one of a musical note and a vibration produced by the string instrument.

20 Claims, 10 Drawing Sheets

ANTI-WOLF-NOTE RESONATOR ASSEMBLY FOR A STRING INSTRUMENT AND METHOD OF ASSEMBLING THE SAME

BACKGROUND OF THE INVENTION

This invention relates generally to string instruments, and more specifically to, an anti-wolf-note resonator assembly for a string instrument and method of assembling the same.

Well constructed, string instruments, such as a cello, may generate a wolf-note when the instrument is played. More specifically, when played, known instruments produce an intended note that vibrate at an intended frequency. However, depending on a strength or amplitude of the intended note, an errant portion of the instrument may vibrate, rattle, flap, or resonate, producing an unintended note at a frequency that is different than that of the intended note. If the instrument produces both the unintended note and the intended note simultaneously, the combined acoustical interference, called a beat, may cause the wolf-note sound to be generated. It is a common practice to refer to both the unintended note and the intended note as the wolf-note, since both may be so close in tone that they sound almost like the same note. However, as is known by those skilled in the art, the wolf-note sounds like a wolf howl and the amplitude modulation is generally uncontrollable and annoying, and may prevent the player of the string instrument from producing a steady clear note. The above explanation, the beating of two notes, is not the only explanation offered in the literature to explain the wolf note. However, for this discussion and for simplicity we will assume that the theory of the beating of two notes describes the wolf-note phenomena.

As a slight digression, we offer, for completeness, a second wolf-note theory. We will call this the "mobile-bridge" theory as opposed to the above "beat-frequency" theory.

In the mobile-bridge theory, the amplitude of the bridge is so great that it periodically dampens the string vibration. For a string to vibrate in a standing wave it has to be firmly fixed at both ends. However in string instruments one end of the string is fixed at the nut near the scroll and the other end is allowed to also vibrate at the bridge. The bridge can vibrate in two modes of oscillation, either in phase with the string or out of phase with the string vibration. If the bridge is out of phase with the string, it will drive the string by reflecting wave energy back into the string. If the bridge is in phase, it will tend to dampen string vibration by moving out of the way and hence absorb wave energy. In practice, the bridge will vibrate back and forth between these two modes. Thus the string will periodically vibrate stronger when out of phase with the bridge, and vibrate weaker when in phase. This vibrating stronger and weaker-in phase and out of phase-is the wolf note sound.

The mobile-bridge theory explains why cellos more often have a wolf note as compared to violins and violas. It is because the cello's bridge is proportionally taller. Thus the top of the cello bridge has greater amplitude of vibration and hence vibrates in and out of phase more easily.

Typically, the wolf note occurs at a frequency where the cello vibrates the strongest, at what is called the main wood mode of oscillation. This is the simplest, greatest amplitude, and lowest mode of vibration for the top of the instrument. To prevent the wolf note we need to reduce this exaggerated vibration.

At least one known method to suppress the wolf-note is to take energy away from the main wood mode of oscillation by attaching a weight to a string of the instrument such that the weight is positioned between the bridge of the instrument and the tailpiece of the instrument. The weight must be tuned to oscillate at the frequency of the main wood vibration. However, as is known, the size and position of the weight on the string may be critical to suppressing the wolf note. For example, as the string ages and/or stretches, the string may require retuning. After retuning, the weight may need repositioning to be effective in suppressing the wolf-note. Moreover, such devices may provide only limited results, and as such the main wood note may still remain uncomfortably loud although the wolf note has been suppressed.

Another known solution in suppressing wolf-notes is to permanently attach a resonant weighted device, a damper, to the string instrument. A musician, through trial and error, determines the most effective or optimum location for such a device. Once the most effective position is identified, the device is inserted into the cavity of the instrument and is permanently coupled to an interior surface of the instrument. Because the devise is permanently coupled to the instrument with an adhesive material, it cannot easily be repositioned, and/or cannot be removed without the assistance of a repair shop.

BRIEF DESCRIPTION OF THE INVENTION

In one aspect, a method of assembling an anti-wolf resonator assembly for use with a string instrument is provided. The method includes positioning a first portion of the resonator assembly against a first side of a surface of the instrument, and magnetically coupling a second portion of the resonator assembly to a second side of the instrument surface that is opposite the first side of the surface. The surface is positioned between the first and second portions of the resonator assembly. The resonator assembly is configured to dampen at least one of a musical note and a vibration produced by the string instrument.

In another aspect, a string instrument assembly is provided. The assembly includes a string instrument including an outer surface, and an anti-wolf resonator sub-assembly configured to be magnetically coupled to the outer surface. The anti-wolf resonator sub-assembly includes a first member coupled against a first side of the outer surface, and a second member magnetically coupled to the first member such that the outer surface is between the first and second members. The resonator sub-assembly is positioned to facilitate damping at least one of a musical note and a vibration produced by the string instrument.

In a further aspect, an anti-wolf resonator assembly for use with a string instrument is provided. The resonator assembly includes a first member configured to be positioned against a first side of an outer surface of the string instrument, and a second portion configured to be magnetically coupled to a second side of the string instrument surface. The surface is positioned between the first and second members of the resonator assembly. The resonator assembly is configured to dampen at least one of a musical note and a vibration produced by the string instrument.

DETAILED DESCRIPTION OF THE INVENTION

Figure 1:
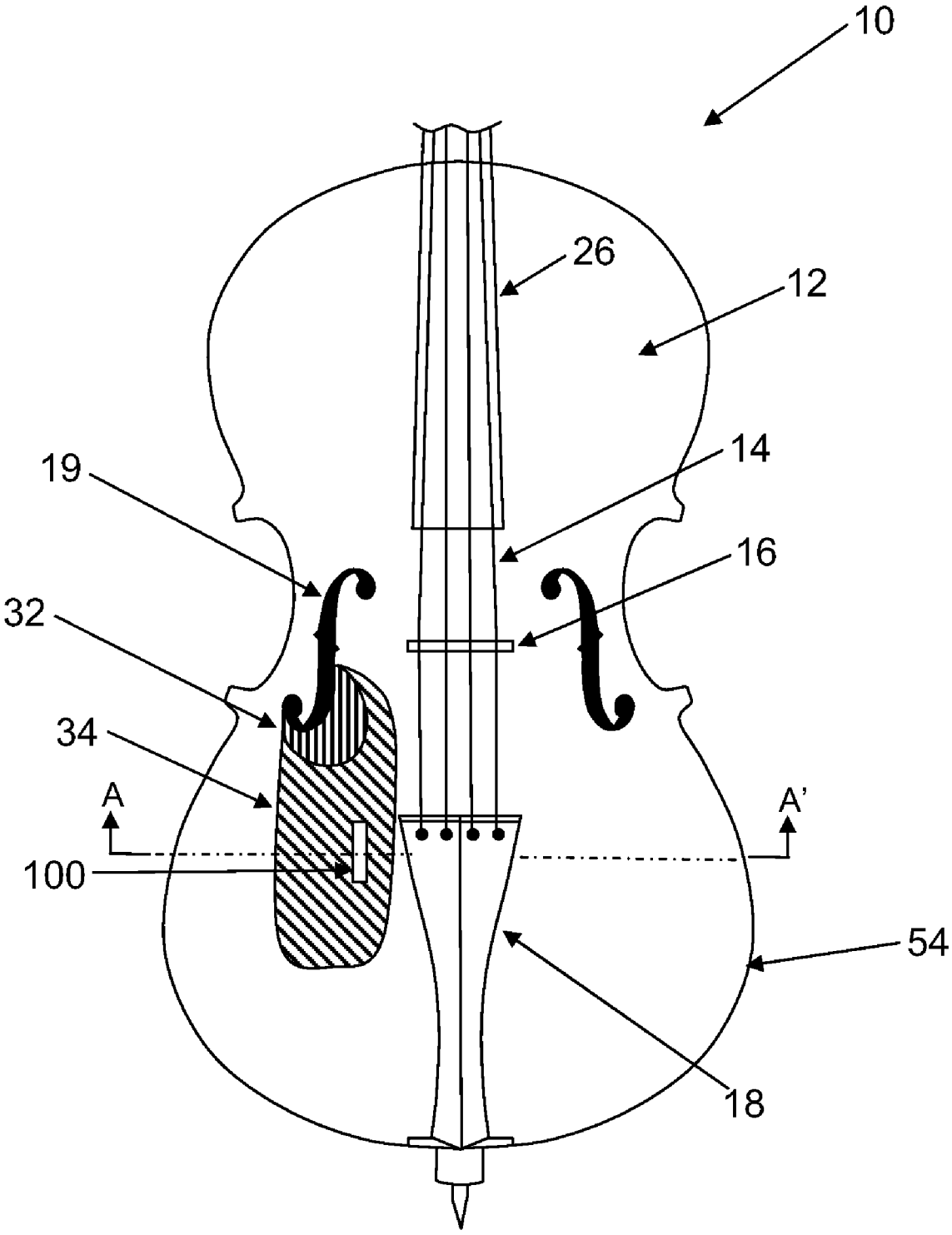
FIG. 1 is a front view of an exemplary string instrument including an exemplary anti-wolf resonator assembly.
Figure 3:
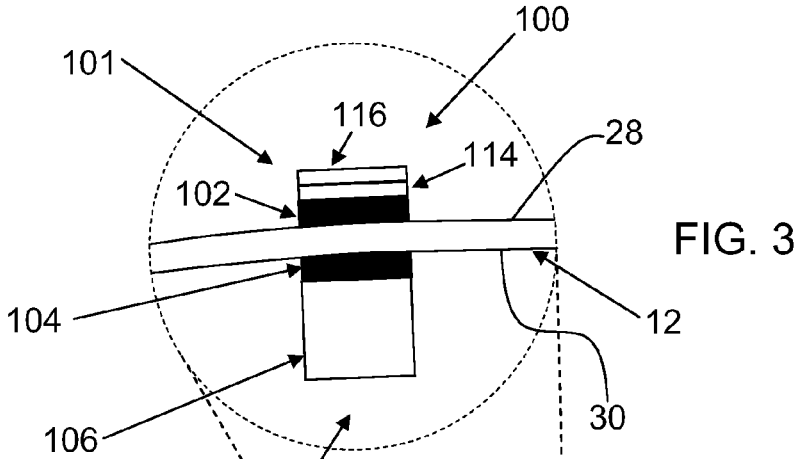
FIG. 3 is an enlarged view of a portion of the instrument and assembly shown in FIG. 2.
Figure 2:
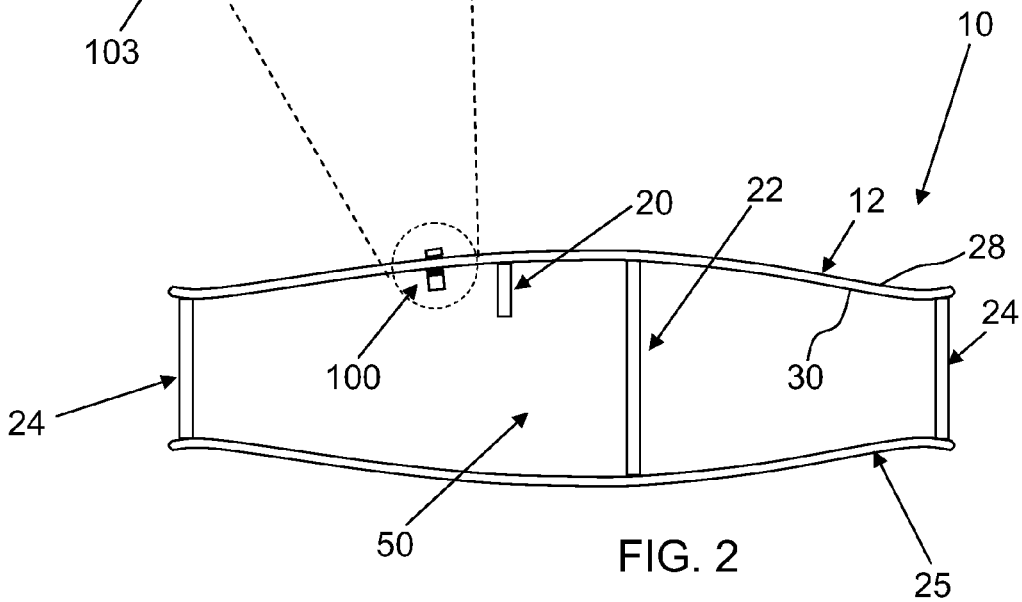
FIG. 2 is a cross-sectional view of a portion of the instrument and assembly shown in FIG. 1 and taken along line A-A'.

FIG. 1 is a front view of a string instrument 10 including an anti-wolf resonator assembly 100 coupled to instrument 10 to facilitate suppressing a wolf-note generated by instrument 10. FIG. 2 is a cross-sectional view of a portion of instrument 10 and assembly 100 and taken along line A-A'. FIG. 3 is an enlarged view of instrument 10 and assembly 100 shown in FIG. 2. In the exemplary embodiment, instrument 10 is a cello. Alternatively, instrument 10 may be a violin, a viola, a bass, or any string instrument that may generate at least a wolf-note or an excessively loud note when played. In the exemplary embodiment, instrument 10 includes a top plate or a surface 12, a plurality of strings 14, a bridge 16 that secures strings 14 a distance away from top plate 12, a tailpiece 18, and at least one f-hole 19 that is defined within top plate 12. In the exemplary embodiment, top plate 12 includes a first surface or a first side 28 and an opposite second surface or a second side 30. Instrument 10 also includes a bass bar 20, a sound post 22, at least one rib 24, and a bottom plate 25. Sound post 22 prevents top plate 12 from collapsing when tension is applied to tune strings 14 or when instrument 10 is played. In the exemplary embodiment, sound post 22 is positioned behind bridge 16 and towards tailpiece 18, such that a first bridge leg extending over sound post 22 will remain substantially stationary, as an opposite second bridge leg is vibrated to generate sound.

In the exemplary embodiment, top plate 12 includes an errant flap 32 defined within area 34 located near an f-hole 19. Errant flap 32 may generate a wolf-note when instrument 10 is played. However, errant flap 32 is not the only part of the instrument that may flap in error. For example, a loose fingerboard on string instrument 10 may vibrate at different resonances generating the wolf-note. As such, any part of the instrument may generate a wolf-note if the part of the instrument is loose or vibrated hard enough such that the frequency of the loose part beats with the frequency of instrument 10. Assembly 100 is configured to be coupled within area 34 to facilitate damping the wolf-note when instrument 10 is played, as is described in more detail below.

Errant flap 32 may generate a wolf-note during operation of instrument 10 by unintentionally vibrating at a first frequency while the remaining portions of instrument 10 vibrate at a second frequency. The second frequency may be close to the first frequency, but is different than the first frequency. Because the first and second frequencies are close to each other, a third frequency that is the average of the first and second frequencies, known as a carrier wave frequency, is heard at this higher frequency. All three frequencies—the first, second, and their average—are so close together that they are almost indistinguishable except to the trained ear. As is known, the carrier wave amplitude is modulated at the difference between the first and second frequencies. Such a modulation, known as the beat frequency is the wolf-note frequency of one or more cycles per second for the cello, for example. The wolf-note frequency can varies from instrument to instrument and thus higher or lower beat frequencies are possible. In the exemplary embodiment, the first and second frequencies are close to f-sharp; the difference between the first and second frequencies is referred to hereinafter as "the wolf-note." It is common practice among musicians to refer to both the carrier and the beat by the all inclusive term "the wolf-note". This is because the musician may hear the wolf-note beat while trying to play a note such as f-sharp. The musician would then say that the instrument has a wolf note on f-sharp.

In the exemplary embodiment, resonator assembly 100 is coupled to instrument 10. More specifically, in the exemplary embodiment, assembly 100 is coupled generally within, but not limited to, area 34 and proximate errant flap 32 to facilitate damping the wolf-note.

Figure 5:
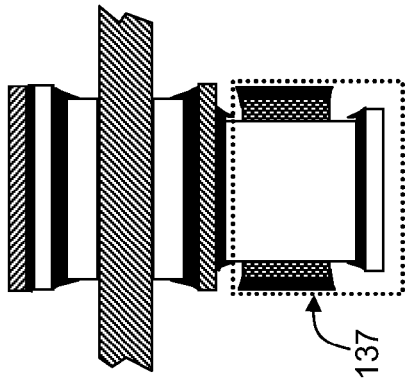
FIG. 5 is an end view of the instrument and assembly shown in FIG. 4.
Figure 4:
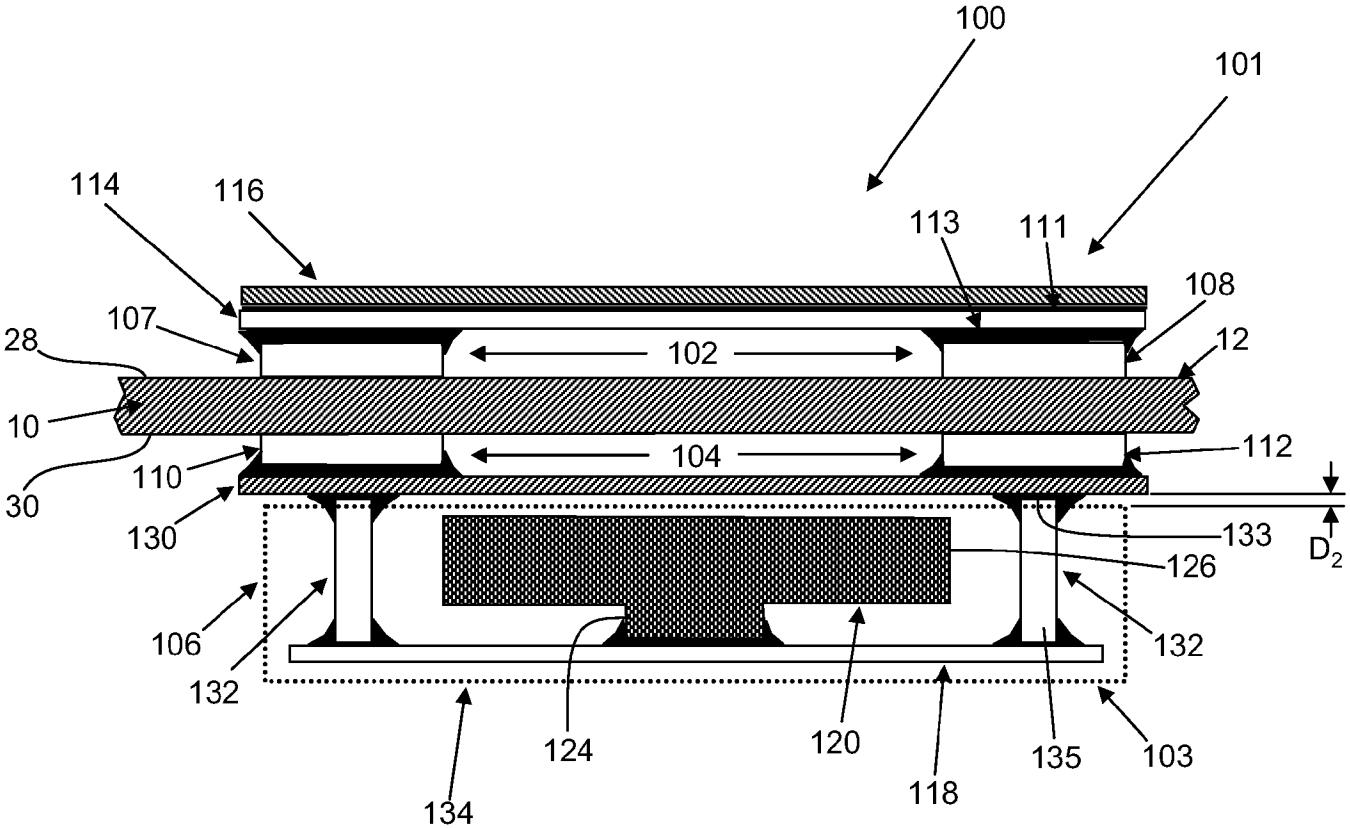
FIG. 4 is an enlarged side view of the instrument and assembly shown in FIG. 2.
Figure 6:
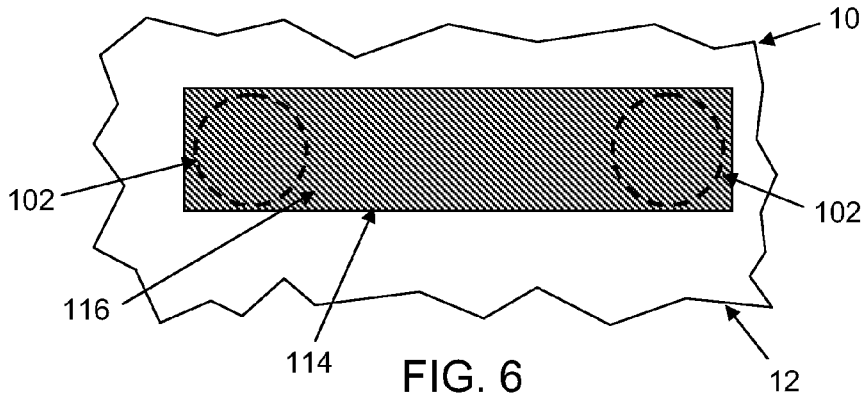
FIG. 6 is a top plan view of the assembly shown in FIG. 4.

FIG. 4 is an enlarged side view of instrument 10 and assembly 100, FIG. 5 is an end view instrument 10 and assembly 100, and FIG. 6 is a top plan view of assembly 100. In the exemplary embodiment, resonator assembly 100 includes a first sub-assembly or a first portion 101 including at least a first magnet 102, and a second sub-assembly or a second portion 103 that includes at least a second magnet 104 and a resonator member 106. Alternatively, assembly 100 may include any number of sub-assemblies, and any number of magnets that enable assembly 100 to function as described herein. Moreover, in the exemplary embodiment, assembly 100 is sized to be inserted through f-hole 19.

First magnet 102 has a first polarity, and second magnet 104 has a second polarity that is opposite of the first polarity such that second magnet 104 is magnetically attracted to first magnet 102. In the exemplary embodiment, magnets 102 and/or 104 are fabricated from a magnetic material, such as but not limited to, iron, that is capable of conducing magnetic lines of flux. In the exemplary embodiment, magnet 102 includes a first button magnet 107 and a second button magnet 108, and magnet 104 includes a first button magnet 110 and a second button magnet 112. In one embodiment, magnets 107, 108, 110, and/or 112 may be earth neodymium disc magnets having a diameter of approximately 0.375" and a thickness of between approximately 0.100" and approximately 0.125". Alternatively, magnets 102 and 104 may have any suitable size and/or shape that enables assembly 100 to function as described herein.

In the exemplary embodiment, first sub-assembly 101 is magnetically couplable to top plate first surface 28 such that first magnet 102 is coupled to first surface 28. Similarly, second sub-assembly 103 is magnetically couplable to top plate second surface 30 such that second magnet 104 is magnetically coupled to second surface 30. More specifically, when assemblies 101 and 103 are coupled to surfaces 28 and 30, respectively, instrument top plate 12 is positioned between first and second magnets 102 and 104. In an alternative embodiment, first sub-assembly 101 does not include magnet 102; rather, first sub-assembly 101 includes a keeper 114, as will be described in more detail below, that is fabricated from a magnetically attractive metal such as, but not limited to, iron. Magnet 104 is then replaced with a stronger magnet to compensate for the loss of magnet 102. In a further alternative embodiment, magnet 104 is coupled to top plate first surface 28 to couple sub-assembly 103 to first surface 28, and magnet 102 is coupled to top plate second surface 30 to couple sub-assembly 101 to second surface 30. Magnetically coupling sub-assemblies 101 and 103 to top plate 12 enables sub-assemblies 101 and 103 to be easily removed from top plate 12 without damaging instrument 10.

Sub-assembly 101 also includes a casing 114 that is oriented to at least partially encase or cover magnet 102. In the exemplary embodiment, casing 114 is adhesively coupled to top plate first surface 28 such that casing 114 substantially encases or covers magnets 107 and 108. Casing 114 has a first surface 111 and an opposite second surface 113. In the exemplary embodiment, casing 114 may have any shape that enables assembly 100 to function as described herein. In one embodiment, casing 114 may be referred to as a keeper when the casing is made of magnetically transmitting material, such as, but not limited to, iron.

In the exemplary embodiment, casing 114 is fabricated from a metallic material that prevents magnet 102 from attracting other magnetic objects or common iron objects proximate instrument 10. For example, in the exemplary embodiment, casing 114 is fabricated from an iron material. Alternatively, casing 114 is fabricated from a transparent plastic material. For example, the plastic material has a thickness of approximately 0.093". In a further alternative embodiment, casing 114 is fabricated from a composite material, a wood material, and/or any combination thereof that enables assembly 100 to function as described herein. In an alternative embodiment, assembly 100 does not include casing 114. In yet another alternative embodiment, assembly 100 includes a plurality of casings 114.

Figure 7:
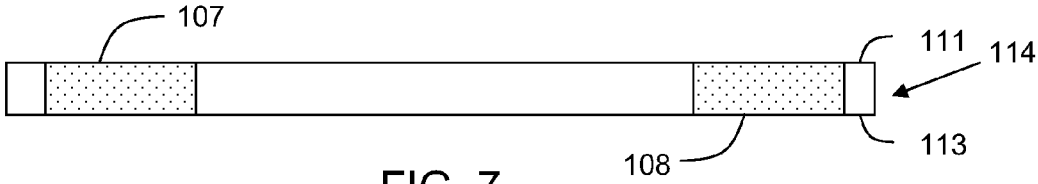
FIGS. 7-11 are a plurality of side views of a portion of the assembly shown in FIG. 4 with different magnet locations.
Figure 8:
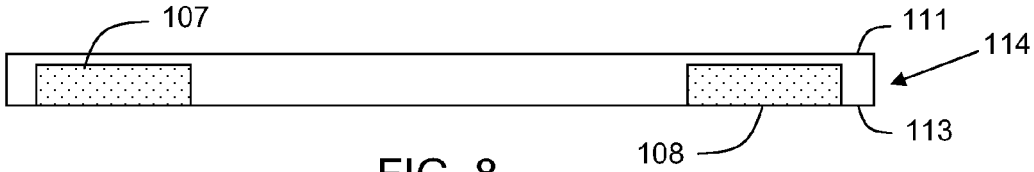
Figure 9:
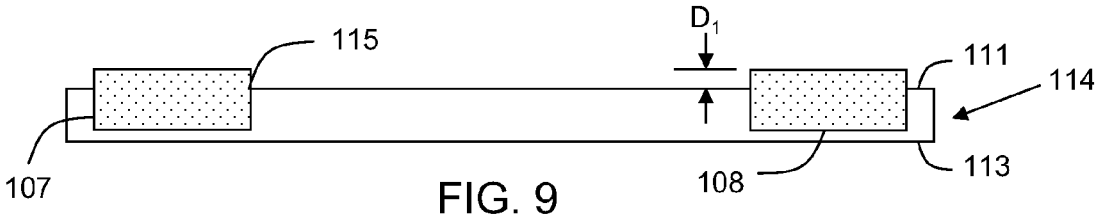
Figure 10:
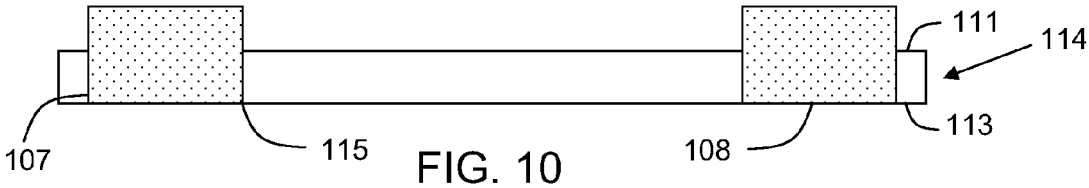
Figure 11:
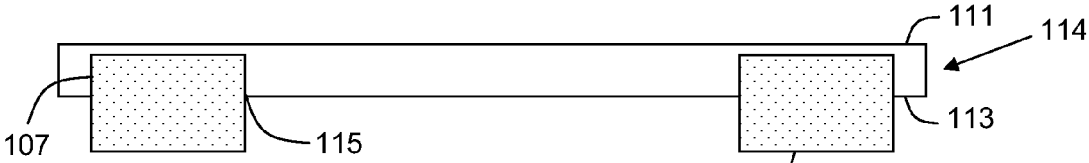

FIGS. 7-11 are side views of the exemplary embodiment of a portion of assembly 100. More specifically, FIGS. 7-11 are side views of casing 114 and magnets 107 and 108 positioned in different locations within casing 114. In FIG. 7, casing 114 encases magnets 107 and 108 such that magnets 107 and 108 extend between surfaces 111 and 113. In FIG. 8, casing 114 encases magnets 107 and 108 such that magnets 107 and 108 are coupled against second surface 113. In FIG. 9, casing 114 includes a plurality of openings 115 defined within its outer surface 111. Each opening 115 is sized to receive magnet 107 and 108, respectively. Accordingly, magnets 107 and 108 are each inserted at least partially through a respective opening 115 such that each extends a distance above surface 111. In FIG. 10, magnets 107 and 108 are coupled against surface 113 and extend through openings 115 a distance above surface 111. In FIG. 11, openings 115 are each defined within surface 113. Each opening 115 is sized to receive a magnet 107 and 108 therethrough. As such, magnets 107 and 108 may be inserted at least partially through an opening 115 such that each extends a distance below surface 113. Alternatively, embodiment casing 114 includes only a single opening defined therein that is sized to receive a single magnet therein.

Referring further to FIGS. 4-6, sub-assembly 101 also includes a finishing member 116 that is coupled to either magnet 102 and/or casing 114 to facilitate hiding or camouflaging resonator assembly 100 on string instrument 10 in a more aesthetically pleasing manner. In the exemplary embodiment, finishing member 116 is sized approximately the same as casing 114 and is fabricated from at least one of a wood material or carbon composite material. Specifically, in the exemplary embodiment, finishing member 116 is a veneer wood layer that has the same coloring and texture as string instrument 10. Moreover, in the exemplary embodiment, member 116 has a nominal weight that substantially prevents interference with the functionality of resonator assembly 100. Alternatively, assembly 100 does not include finishing member 116. When assembly 100 does not include finishing member 116, surface 111 may be finished to match the surface color and texture of instrument 10. In a further embodiment, member 116 is fabricated from any suitable material that enables assembly 100 to function as described herein.

In the exemplary embodiment, member 106 of sub-assembly 103 is coupled to second magnet 104 and includes a spring and weight. Specifically, member 106 includes a biasing member 118 and a weight 120 coupled to member 118. To facilitate damping unwanted resonance, resonator member 106 is tuned to the wolf-note. As such, the dimensions (i.e., the size, weight, and stiffness) of member 118 and the materials used in fabricating weight 120 are selected to facilitate enabling weight 120 and attached casing 134 to vibrate at the wolf-note frequency. In an alternative embodiment, sub-assembly 101 may include a member (not shown) similar to member 106 of sub-assembly 103 to facilitate damping unwanted resonance. Specifically, the member of sub-assembly 101 may include a biasing member and a weight such that the member of sub-assembly 101 may be tuned to a frequency that is the same or different than the frequency of member 106 of sub-assembly 103. If tuned to two different frequencies, member of sub-assembly 101 and member 106 of sub-assembly 103 can dampen two unwanted loud resonances.

In the exemplary embodiment, biasing member 118 is a spring. More specifically, in the exemplary embodiment of FIG. 4, biasing member 118 is a beam-shaped resonator spring. In an alternative embodiment, the spring may be any suitable spring that has a shape and/or that enables assembly 100 to function as described herein. For example, member 118 may be, but is not limited to being, a leaf spring, a bar spring, a metal coil, and/or any combination thereof. In a further alternative embodiment, member 118 is not a spring, but rather is any other biasing member that enables assembly 100 to function as described herein.

In the exemplary embodiment, weight 120 is fabricated from any massive material such as but not limited to a metallic and/or lead material, and includes a base member 124 and a flanged member 126 that extends therefrom. In the exemplary embodiment, base member 124 is coupled to member 118. Alternatively, weight 120 may be any suitable size and/or shape that enables assembly 100 to function as described herein.

Moreover, in the exemplary embodiment illustrated in FIG. 4-6, sub-assembly 103 includes a resonator platform 130 and a pair of spring support legs 132. In the exemplary embodiment, resonator platform 130 is adhesively coupled to magnet 104. Specifically, resonator platform 130 is coupled to magnets 110 and 112 such that platform 130 extends between magnets 110 and 112. In an alternate embodiment, resonator platform 130 can be made of at least one of a magnetically conducting material such as iron, a non-magnetic material such as wood, and/or a combination laminate of both materials adhesively coupled to each other and to magnet 104. An iron resonator platform 130 enhances the magnetic field of magnet 104 by magnetically coupling the magnet fields of magnet 110 and magnet 112. Similarly, iron keeper 114 enhances the magnetic field of magnets 107 and 108 and increases the effective magnetic strength of combined magnets 107 and 108. As such, there is a synergy when resonator platform 130 is made to also act as a magnetic field keeper by making it out of iron.

In the exemplary embodiment, weight 120 is coupled between pair of support legs 132. Each support leg 132 includes a first end 133 and an opposite second end 135. Each first end 133 is coupled to resonator platform 130 and second end 135 is coupled to member 118.

Sub-assembly 103 also includes a casing 134. More specifically, in the exemplary embodiment, casing 134 is trough-shaped having an opening extending across the top and at least partially encases member 118, spring support legs 132, and weight 120. Casing 134 may have any shape that enables assembly 100 to function as described herein. Specifically, casing 134 is slid over biasing member 118, support legs 132, and weight 120, and is coupled to at least one side 137 of weight flanged member 126, as shown in FIG. 5, and is configured to vibrate with member 106. Alternatively, casing 134 may be coupled to support legs 132 and/or biasing member 118 so long as casing 134 does not interfere with the vibrating spring action of biasing member 118.

Casing 134 adds a minimal amount of weight to member 106. For example, in the exemplary embodiment, casing 134 is fabricated from a plastic material. In an alternative embodiment, casing 134 is fabricated from a metallic material, a composite material, a wood material, and/or any material that enables assembly 100 to function as described herein. In an alternative embodiment, assembly 100 includes a plurality of casings 134.

Figure 12:
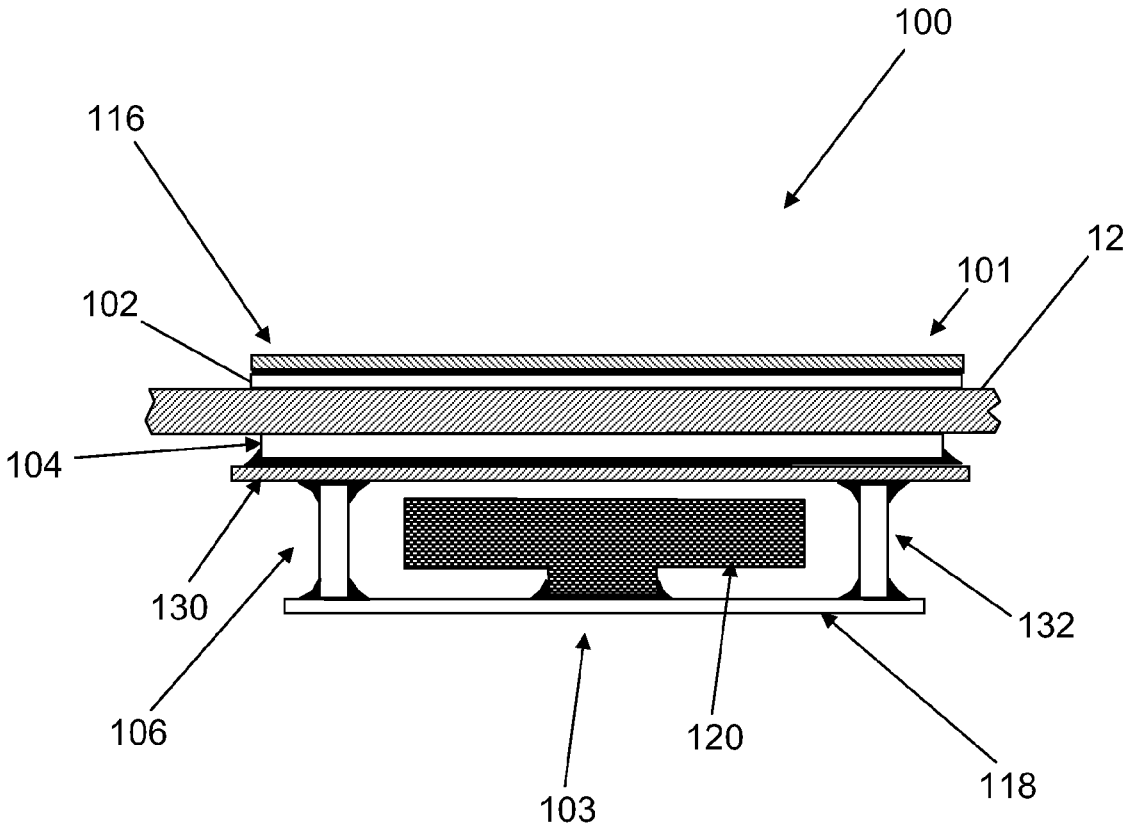
FIG. 12 is a side view of an alternative embodiment of the assembly shown in FIG. 4.

FIG. 12 is a side view of an alternative embodiment of assembly 100 shown in FIG. 4. As shown in FIG. 12, assembly 100 includes sub-assemblies 101 and 103. Sub-assemblies 101 and 103 are similar to assembly 100 shown in FIG. 4 and like components are identified with like reference numerals. In contrast to the embodiment shown in FIG. 4, each magnet 102 and 104 shown in FIG. 12 is a unitary bar magnet. Moreover, in contrast to the embodiment shown in FIG. 4, assembly 100 illustrated in FIG. 12 does not include casings 114 and 134.

Figure 13:
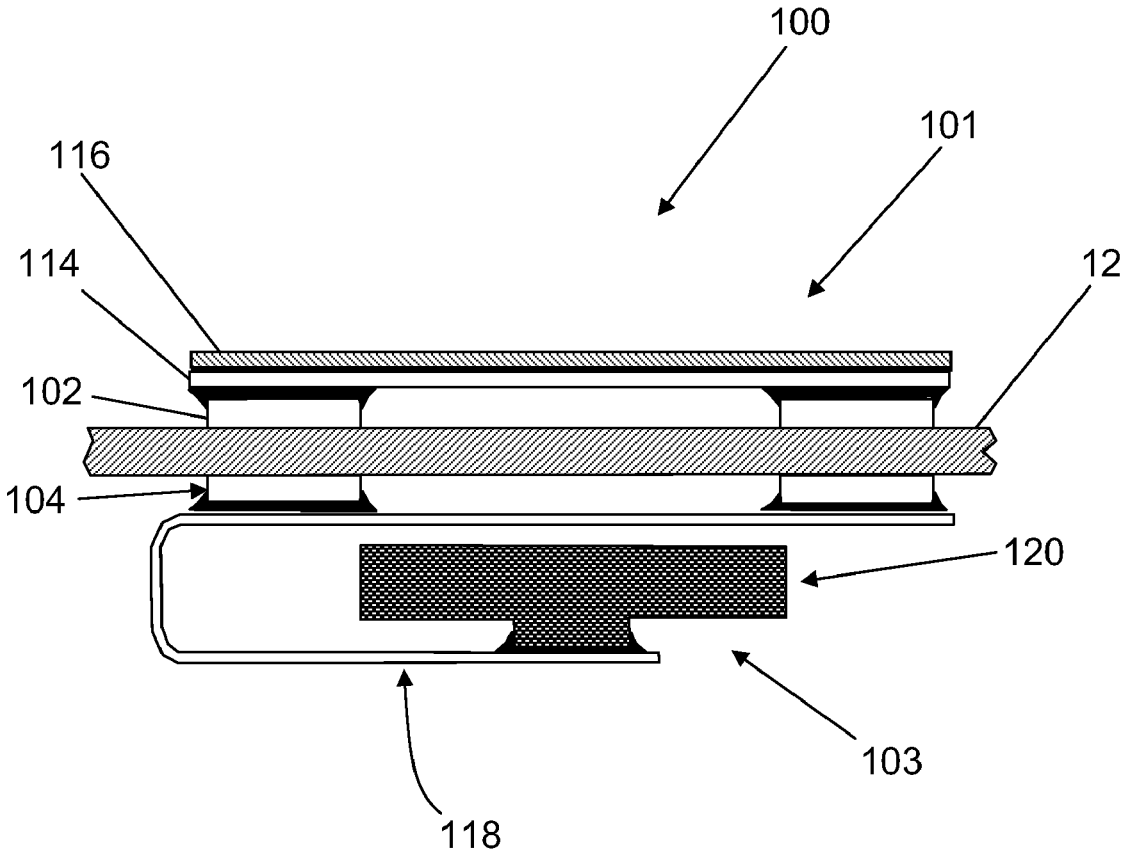
FIG. 13 is a side view of another alternative embodiment of the assembly shown in FIG. 4.

FIG. 13 is a side view of another alternative embodiment of assembly 100 shown in FIG. 4. As shown in FIG. 13, assembly 100 includes sub-assemblies 101 and 103. Sub-assemblies 101 and 103 are similar to assembly 100 shown in FIG. 4 and like components are identified with like reference numerals. In contrast to the embodiment shown in FIG. 4, member 118 shown in FIG. 13 is a C-spring. Moreover, in contrast to the embodiment shown in FIG. 4, resonator member 106 shown in FIG. 13 only includes member 118 and weight 120, and does not include resonator platform 130 or support legs 132. As such, member 118 is coupled directly to magnet 104.

Figure 14:
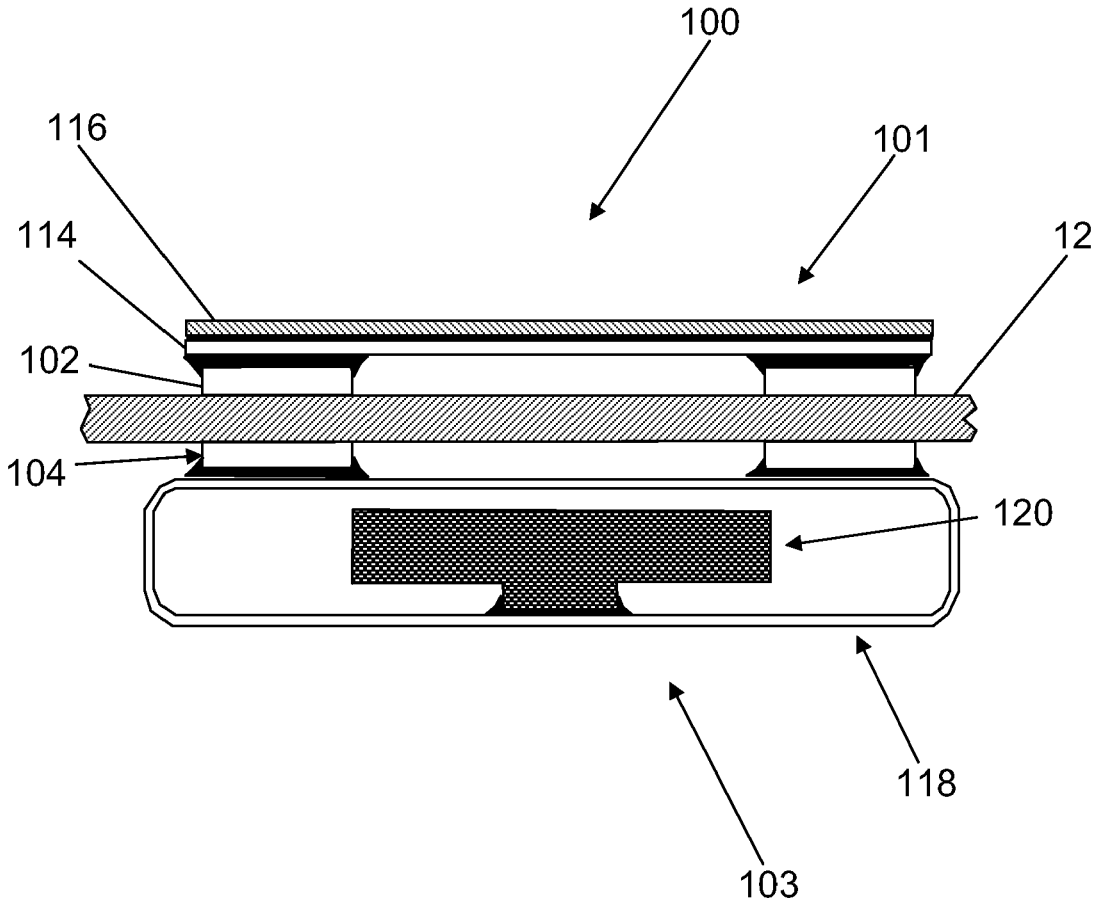
FIG. 14 is a side view of a further alternative embodiment of the assembly shown in FIG. 4.

FIG. 14 is a side view of a further alternative embodiment of assembly 100 shown in FIG. 4. As shown in FIG. 14, assembly 100 includes sub-assemblies 101 and 103. Sub-assemblies 101 and 103 are similar to assembly 100 shown in FIG. 4 and like components are identified with like reference numerals. In contrast to the embodiment shown in FIG. 4, member 118 shown in FIG. 14 is an oval spring that is similar to includes two C-springs that provide additional support to weight 120. Moreover, in contrast to the embodiment shown in FIG. 4, resonator member 106 shown in FIG. 14 only includes member 118 and weight 120, and does not include platform 130 or support legs 132. As such, member 118 is coupled directly to magnet 104.

Figure 15:
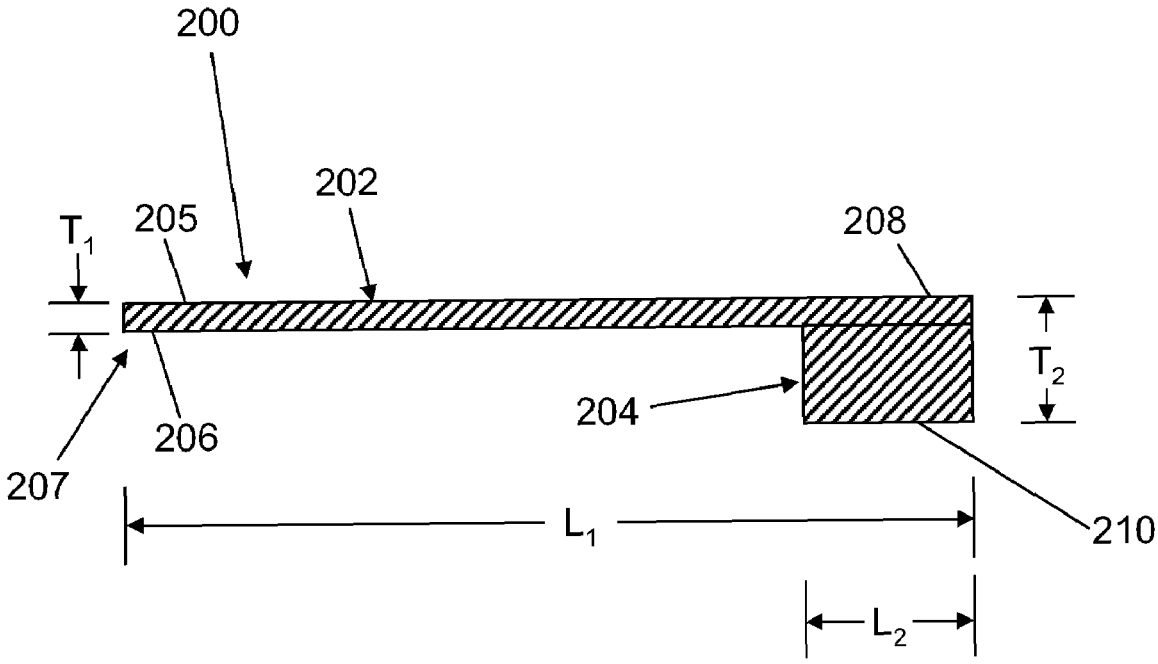
FIG. 15 is a side view of an exemplary mounting device that may be used with the assembly shown in FIG. 1.

FIG. 15 is a top plan and side view of an exemplary mounting device 200 that may be used with assembly 100. Because a musician may have difficulty inserting assembly 100 into f-hole 19, mounting device 200 may be used to couple assembly 100 to string instrument 10. Accordingly, in the exemplary embodiment, mounting device 200 is sized to be inserted at least partially within f-hole 19. In the exemplary embodiment, mounting device 200 includes a handle 202 and a lip 204. Handle 202 includes a first surface 205 and an opposite second surface 206. Lip 204 is coupled to handle surface 206 proximate ann end 207. Moreover, in the exemplary embodiment, handle 202 has a substantially rectangular shape that is defined by a length $L_1$, a width $W_1$ (not shown) such that $L_1$ is greater than $W_1$, and a thickness $T_1$. Lip 204 has a first surface 208 and an opposing surface 210. Lip 204 also has a substantially rectangular shape defined by a length $L_2$, width $W_1$, and a thickness $T_2$. Moreover, length $L_1$ is longer than length $L_2$, and thickness $T_2$ is wider than thickness $T_1$. Device 200 may be fabricated from any material that enables assembly 100 to be coupled to string instrument 10 as described herein.

Figure 16:
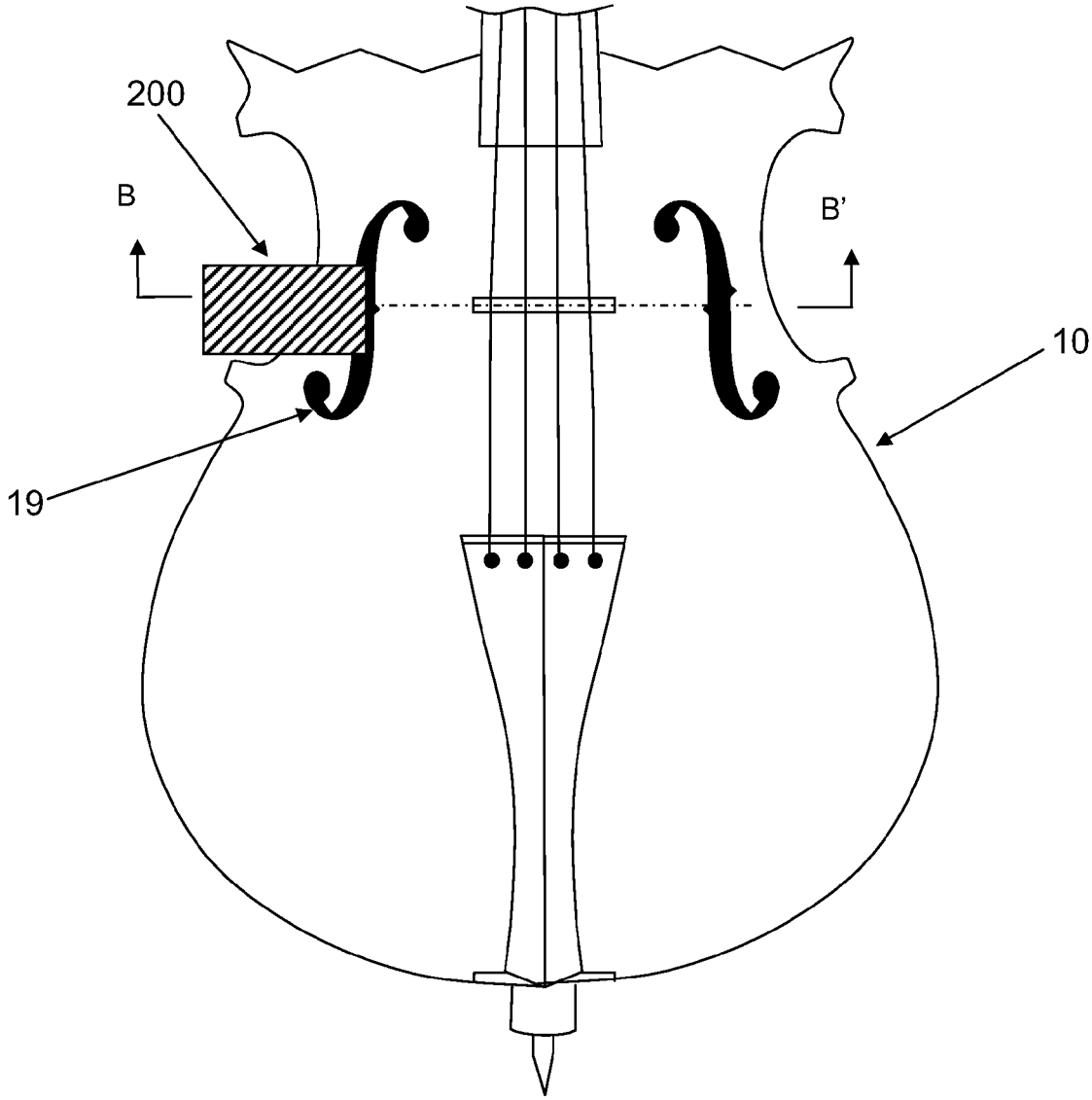
FIG. 16 is a top plan view showing the use of the instrument in FIG. 1 and the mounting device shown in FIG. 15.
Figure 17:
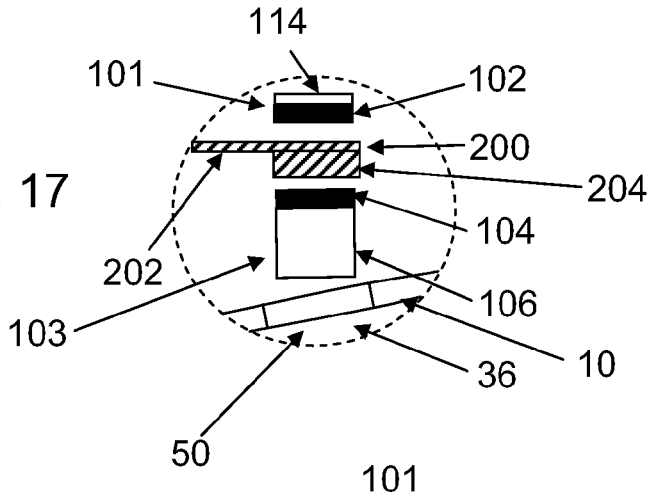
FIGS. 17-20 are cross-sectional views of a portion of the instrument shown in FIG. 1 and the mounting device shown in FIG. 15 and taken along line B-B'.

FIG. 16 is a top plan view of a portion of instrument 10, assembly 100 (not shown), and mounting device 200. Assembly 100 is more clearly shown assembled onto mounting device 200 as shown in FIG. 17. During assembly, sub-assemblies 101 and 103 are assembled and then removably coupled to instrument 10. Specifically, in the exemplary embodiment, to assemble sub-assembly 101, magnet 102 is inserted into casing 114. Alternatively, magnet 102 may be inserted at least partially into casing 114 and through opening 115 such that magnet 102 extends a distance $D_1$ above casing surface 111, as shown in FIGS. 9 and 10. Once magnet 102 is positioned within casing 114, finishing member 116 is coupled to casing 114 such that sub-assembly 101 substantially matches the texture and color of string instrument 10.

In the exemplary embodiment, to assemble sub-assembly 103, resonator platform 130 is adhesively coupled to magnet 104. Spring support leg second ends 135 are then coupled to beam member 118 such that member 118 extends between ends 135. Weight 120 is then coupled between support legs 132 such that base member 124 is secured to member 118. Casing 134 is then coupled to at least one weight side 137 to substantially encase legs 132, member 118, and weight 120. In the exemplary embodiment, leg first ends 133 extend a distance $D_2$ above casing 134 and are coupled to resonator platform 130. Alternatively, when assembly 100 does not include resonator platform 130, member 118 and member 120 are coupled together, and member 118 is coupled directly to magnet 104 (shown in FIGS. 13 and 14, for example).

FIGS. 17-20 are cross-sectional views instrument 10 and mounting device 200 taken along line B-B' in FIG. 16. Specifically, FIGS. 17-20 illustrate mounting assembly 100 to string instrument 10. Once sub-assemblies 101 and 103 are assembled, each assembly 101 and 103 is removably coupled to string instrument 10. Specifically, in one embodiment, assemblies 101 and 103 are coupled to string instrument 10 using mounting device 200. Specifically, device 200 couples sub-assembly 101 to top plate first surface 28 via magnet 102, and sub-assembly 103 is coupled to top plate second surface 30 via magnet 104. Accordingly, when magnet 102 is coupled to top plate first surface 28 and magnet 104 is coupled to top plate second surface 30, an attractive magnetic field is generated through top plate 12 which movably, yet firmly, holds assemblies 101 and 103 in place. The musician can slide assembly 100 across instrument 10 to minimize the loud resonance that creates the wolf-note.

Figure 18:
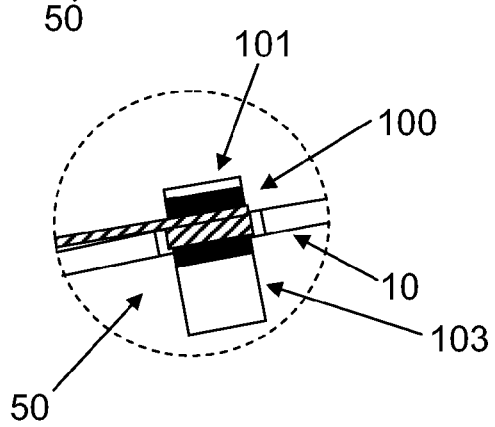
Figure 19:
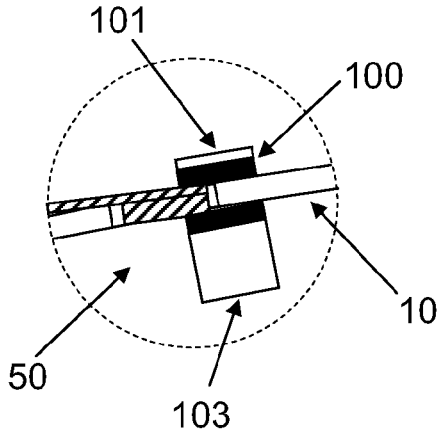
Figure 20:
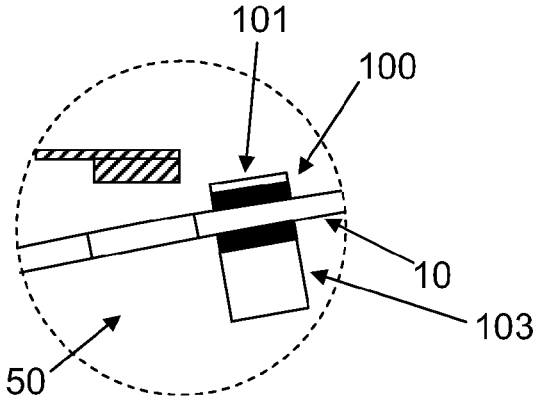

A user positions device 200 using handle 202. Sub-assembly 101 is placed adjacent to handle first surface 205 near first end 207, and sub-assembly 103 is placed adjacent to lip 204 such that the magnetic field is conducted through device 200 as shown in FIG. 17. In FIG. 18, after sub-assemblies 101 and 103 are magnetically coupled to device 200, the device 200 is moved generally vertically into f-hole 19 such that sub-assembly 103 is at least partially inserted into a cavity 50 defined within string instrument 10. Device 200 is then moved generally horizontally such that device first end 207 is positioned substantially flush against with a portion of f-hole 19. A user then slides sub-assembly 101 across top plate first surface 28 as shown in FIG. 19. Movement of sub-assembly 101 causes sub-assembly 103 to be slid across top plate second surface 30 via the magnetic coupling of magnets 102 and 104. After sub-assemblies 101 and 103 are positioned relative to top plate 12, device 200 is moved upward to remove device 200 from f-hole 19 as shown in FIG. 20. The user may then slide assembly 100 from the f-hole along top plate 12 to a desirable final position on string instrument 10 as shown in FIG. 1. The magnetic coupling between magnets 102 and 104 ensures assembly 100 is retained in position while instrument 10 is played or transported in its carrying case. Moreover, assembly 100 is easily positioned relative to top plate 12 without adversely effecting or scratching the surface finish of first surface 28 of string instrument 10.

During operation of string instrument 10, when a bow is drawn across strings 14, bridge 16 is moved. Moreover, string instrument top plate 12 vibrates to generate a portion of the sound volume, and the remaining sound volume is generated from the bottom 25 of string instrument 10. The sound is conveyed to the back side 25 through sound post 22 and sides of instrument 10.

Assembly 100 facilitates substantially reducing and/or eliminating the wolf-note generated when instrument 10 is played. Generally, the closer in proximity that assembly 100 is moved towards bass bar 20, the more effective assembly 100 is in damping the wolf-note. Assembly 100 can easily be moved, while the instrument is played, such that the wolf-note and its amplitude are substantially reduced until the tamed wolf-note amplitude substantially matches the amplitude of adjacent notes to produce what is called an evenness of tone (i.e. more even amplitude) from note to note. Assembly 100, and specifically member 106, has the greatest damping effect when positioned in close proximity to the center of instrument 10 and near bass bar 20 at a location where top plate 12 vibrates at greater amplitude than at the outer edges 54 of instrument 10.

Assembly 100 also facilitates damping a loud resonant note that initially caused the wolf-note. Although assembly 100 will substantially eliminate the wolf-note beat of 2-5 cycles per second, for example, it is also desirable to reduce the large amplitude resonance (i.e., the loudness) of what was the wolf-note. For example, in the case of the cello, the wolf-note may have occurred at f-sharp because instrument 10 has a loud resonance at f-sharp. After assembly 100 eliminates the wolf-note beat, f-sharp may still be too loud. To change this loud wolf-note resonance (i.e., f-sharp), assembly 100 may be repositioned across top plate 12. Specifically, as assembly 100 is moved towards bass bar 20, the wolf-note resonance (i.e., f-sharp) is decreased and in contrast, as assembly 100 is moved away from bass bar 20, the wolf-note resonance is increased. The preferred position of assembly 100 is where the evenness of tone of the instrument is preserved. In the exemplary embodiment, assembly 100 is not positioned on the bass bar 20 itself, because bass bar 20 blocks sub-assembly 103. Assembly 100 may be placed on any surface of instrument 10 such that the position of assembly 100 is not limited to area 34. For example, assembly 100 may be coupled under tailpiece 18.

In the exemplary embodiment, generally assembly 100 is coupled to top plate 12 within area 34, and more specifically near flap 32, to facilitate damping the wolf-note. Assembly 100 is most effective in damping the wolf-note when member 106 is tuned to resonate at the wolf-note frequency such as f-sharp for example. Specifically, the size (i.e., stiffness) of member 118 and the mass of weight 120 enable member 106 to resonate at the wolf-note frequency.

During operation, instrument 10 vibrates. Moreover, as top plate 12 vibrates, assembly 100 vibrates. As member 106 vibrates, weight 120 facilitates preventing top plate 12 from vibrating as weight 120 is positioned against member 118 wherein weight 120 oscillates in an opposite direction than top plate 12. For example, during resonance, as top plate 12 starts moving upward, weight 120 resists the movement and causes member 118 to pull against top plate 12 such that movement of top plate 12 is substantially prevented. Similarly, when top plate 12 starts to move downward, the inertia of weight 120 resists the movement and causes member 118 to push against top plate 12 such that movement of top plate 12 is substantially prevented. As the vibration of instrument 10 continues, weight 120 vibrates to facilitate damping movement of top plate 12 by moving in an opposite direction than top plate 12. As such, member 106 facilitates reducing and/or preventing the wolf-note by opposing the extra loud resonance of instrument 10.

Described herein is an anti-wolf-note resonator assembly that may be removably coupled to a wide variety of string instruments. The anti-wolf resonator assembly described herein facilitates improving the performance of the instrument by substantially reducing or eliminating the wolf-note. The assembly is magnetically coupled to the instrument such that the assembly is easily coupled to the instrument, easily repositioned on the instrument, and/or easily removed from the instrument. Magnetically coupling the assembly to the instrument also ensures that the assembly will not damage and/or devalue the instrument. The anti-wolf resonator assembly described herein is a relatively low cost, effective, and light weight modification that may significantly increase the sound quality of assorted string instruments.

While the above-described assembly is described for use with a bowed orchestral instrument, the assembly may also be used with a plucked string instrument such as an acoustic guitar, a struck string instrument, and other bowed string instruments. Although plucked instruments generally do not have a wolf-note, the instrument will sometimes have extra loud resonances that make a note too loud when the instrument is played. Coupling assembly 100 to a plucked string instrument will reduce the amplitude of the resonance and promote evenness of tone.

An exemplary embodiment of a resonator assembly for a string instrument is described above in detail. The resonator assembly illustrated is not limited to the specific embodiments described herein, but rather, components of each assembly may be utilized independently and separately from other components described herein.

While the invention has been described in terms of various specific embodiments, those skilled in the art will recognize that the invention can be practiced with modification within the spirit and scope of the claims.

What is claimed is:

1. A method of assembling an anti-wolf resonator assembly for use with a string instrument, the string instrument comprising a body including a wall having a first side and an opposing second side, said method comprising:

positioning a first portion of the resonator assembly against the first side of the wall; and magnetically coupling a second portion of the resonator assembly against the second side of the wall such that the wall is positioned between the first and second portions of the resonator assembly, the resonator assembly is configured to dampen at least one of a vibration and a musical note produced by the string instrument.

2. A method in accordance with claim 1 wherein the resonator assembly includes at least one biasing member and at least one weight, said method further comprises:

coupling the weight to the biasing member; and coupling the weight and biasing member within at least one of the first portion and the second portion.

3. A method in accordance with claim 2 wherein the second portion includes at least one support post, said method further comprising coupling a casing to at least one of the weight, the support post, and the biasing member to substantially encase at least one of the weight, the support post, and the biasing member therein.

4. A method in accordance with claim 1 wherein the resonator assembly first portion includes at least one magnet, said method further comprises coupling a casing to the first portion to substantially encase the first portion magnet therein.

5. A method in accordance with claim 4 wherein the resonator assembly second portion includes at least one magnet, said method further comprises:

coupling the first portion magnet against the first side; and coupling the second portion magnet directly against the second side.

6. A method in accordance with claim 1 wherein the resonator assembly includes a resonator platform, said method further comprises coupling the resonator platform to the second portion using a magnet included in the second portion.

7. A method in accordance with claim 1 further comprising adhesively coupling a finishing member to at least one of the first portion and the second portion.

8. A string instrument assembly comprising:

a string instrument comprising a body including a wall having a first side and an opposing second side; and an anti-wolf resonator sub-assembly configured to be magnetically coupled to said wall, said anti-wolf resonator sub-assembly comprising:

a first member coupled against the first side of said wall; and a second member magnetically coupled to said first member such that said wall is between said first and second members, said resonator sub-assembly positioned to facilitate damping at least one of a musical note and a vibration produced by said string instrument.

9. An anti-wolf resonator assembly for use with a string instrument, the string instrument comprising a body including a wall having a first side and an opposing second side, said resonator assembly comprising:

a first member configured to be positioned against the first side of the wall; and a second member configured to be magnetically coupled against the second side of the wall such that the wall is positioned between said first and second members, said resonator assembly is configured to dampen at least one of a musical note and a vibration produced by the string instrument.

10. An anti-wolf resonator assembly in accordance with claim 9 wherein said first member comprises at least one magnet, said second member comprises at least one magnet, said first member magnet is configured to couple against the first side of the wall, said second member magnet is configured to couple directly to the second side of the wall, each of said first member and second member magnets comprises one of a bar magnet, a disc magnet, and a button magnet.

11. An anti-wolf resonator assembly in accordance with claim 10 wherein said first member further comprises a casing configured to at least partially encase said first member magnet.

12. An anti-wolf resonator assembly in accordance with claim 11 wherein said casing is fabricated from at least one of a substantially transparent, translucent, and opaque material.

13. An anti-wolf resonator assembly in accordance with claim 11 wherein said first member further comprises a finishing member configured to couple to at least one of said first member magnet and said casing.

14. An anti-wolf resonator assembly in accordance with claim 9 wherein said second member comprises a resonator member comprising at least one biasing member and at least one weight.

15. An anti-wolf resonator assembly in accordance with claim 14 wherein said second member further comprises a casing configured to at least partially encase said resonator member.

16. An anti-wolf resonator assembly in accordance with claim 15 wherein said second member comprises at least one magnet, at least one of said resonator member and said second member casing is adhesively coupled to said second member magnet.

17. An anti-wolf resonator assembly in accordance with claim 14 wherein said biasing member comprises at least one of a leaf spring, a bar spring, a C-spring, an oval-shaped spring, and a coil spring.

18. An anti-wolf resonator assembly in accordance with claim 14 wherein said biasing member comprises at least one of a metal material, an elastic material, and a rubber material.

19. An anti-wolf resonator assembly in accordance with claim 9 wherein said anti-wolf resonator assembly is sized to be inserted into at least one of an f-hole and a cavity defined within the string instrument.

20. An anti-wolf resonator assembly in accordance with claim 9 wherein said first member comprises a resonator member comprising at least one biasing member and at least one weight.

* * * * *